United States Patent [19]

Tames

[11] Patent Number: 4,523,347

[45] Date of Patent: Jun. 18, 1985

[54] DISPOSABLE FLOOR MOP

[76] Inventor: Esther R. Tames, 1279 E. 17th St., Brooklyn, N.Y. 11230

[21] Appl. No.: 550,878

[22] Filed: Nov. 14, 1983

[51] Int. Cl.[3] ..... A47L 13/20

[52] U.S. Cl. ..... 15/104.94; 15/147 R; 15/118; 15/228

[58] Field of Search ..... 15/104.93, 104.94, 147 R, 15/147 A, 105, 118, 228, 229 A, 229 R

[56] References Cited

U.S. PATENT DOCUMENTS

| | | | |
|---|---|---|---|
| 1,851,811 | 3/1932 | Christie | 15/104.93 |
| 1,986,924 | 1/1935 | Estes | 15/229 A |
| 1,993,215 | 3/1935 | Hoyt et al. | 15/104.94 |
| 2,233,289 | 2/1941 | Hatzenbuehler | 15/229 |
| 2,733,468 | 2/1956 | Haber | 15/225 |
| 2,743,471 | 5/1956 | Forrester | 15/228 |
| 2,860,361 | 11/1958 | Moody | 15/104.94 |
| 2,969,626 | 1/1961 | Rudes | 15/104.93 X |
| 3,015,834 | 1/1962 | Marrinson et al. | 15/104.94 X |
| 3,121,249 | 2/1964 | Affleck et al. | 15/104.93 |
| 3,199,136 | 8/1965 | George | 15/228 X |
| 3,230,565 | 1/1966 | Koch | 15/229 |
| 3,350,735 | 11/1967 | Pratt | 15/104.94 |
| 3,412,418 | 11/1968 | Griffin | 15/104.93 X |
| 3,414,927 | 12/1968 | Worcester | 15/104.93 |
| 3,817,004 | 6/1974 | Moss | 15/229 X |
| 3,827,099 | 8/1974 | Aliaire | 15/229 |
| 3,896,518 | 7/1975 | Von Post et al. | 15/104.94 |
| 4,114,224 | 9/1978 | Disko | 15/229 A |

FOREIGN PATENT DOCUMENTS

| | | | |
|---|---|---|---|
| 2827909 | 1/1980 | Fed. Rep. of Germany | 15/228 |
| 983724 | 2/1965 | United Kingdom | 15/104.94 |

*Primary Examiner*—Philip R. Coe
*Assistant Examiner*—Frankie L. Stinson
*Attorney, Agent, or Firm*—William T. Hough

[57] ABSTRACT

In a preferred embodiment, a disposable mop has two sets of paper sheets of water-absorbent qualities separated by a water-impervious plastic sheet, one of the sets being impregnated with a detergent such that when wet or moistened with water is suitable for mopping a floor, and the remaining set being free of detergent and suitable for drying a detergent-mopped floor, the two sets and the plastic sheet being joined together at one end by appropriate clamping or binding element mounted removably on an end of an elongated handle for removal and replacement after use.

10 Claims, 2 Drawing Figures

DISPOSABLE FLOOR MOP

This invention is directed to a single use novel disposable mop for wet-mopping a floor.

BACKGROUND TO THE INVENTION

Prior to the present invention, it has been necessary to wet a sponge and sprinkle detergent or soap on the surface to be wet-mopped, or to add such to the wetting water, and thereafter necessary to rinse the mop in clean soapless water and squeeze or otherwise press the water from the rinsed mop prior to dry-mopping the detergent and water-covered floor. Thereafter the dirty and sudsy mop had to be again rinsed and dried or squeezed. This procedure was the same whether for a foam rubber or cloth mop.

BROAD DESCRIPTION OF THE INVENTION

Broadly the invention is directed to achieving at-least the following typical objects. One object is to avoid the time consuming above-noted procedure and to avoid distasteful soiling of the hands and the use of special mopping buckets and the like. It is concurrently desirable to eliminate the need to reuse soiled and possibly contaminated previously used mops. Also it is desirable to obviate the prior need for detergent bottles or packages or containers of dry or liquid soap, and the opening and storing and spilling of the contents therefrom.

These objects are obtained by the following inventive device broadly stated, and preferred embodiments thereof.

Broadly the device is a mop device of disposable nature, that includes at-least two water-absorbent materials separated by a water-impervious material; of the absorbent materials separated, one thereof includes thereon a cleansing agent, while the separated other one is free of such agent such that it may be used to mop-up and dry-up a moist or wet and detergent or soap or other cleansing agent-covered floor previously mopped by a wet or dampened first coated one of the water-absorbent materials above-noted.

Obviously, with the present invention being directed to principally wet-mopping, the preferred cleansing agent is a sudsing agent such as any water miscible cleansing agent. Among such water-miscible cleansing agents, any conventional detergent or soap composition or mixture may be the substance coated on or impregnated into the absorbent material above-noted to be treated with the cleansing agent, preferably soap since soap is better subject to impregnation and drying within the water-absorbent material. Soap or detergent may come separate for later applying.

The separated water-absorbent materials and separating water-impervious material are joined-together at at-least one common end of all thereof. Preferably the remaining opposite ends thereof are free and loose in an unanchored state and condition.

For a preferred utility of the invention, namely wet floor mopping, it is preferred that the joined-together or anchored together portions be mounted on a distal end of an elongated handle. Preferably the anchored water-absorbent material and separating material are detachably mounted on the above-noted handle such that it may be easily detached from the handle and discarded when used or soiled. A typical releasable mechanism is a conventional handle mop-gripping and releasable clamp herein typically illustrated as a mere example.

In preferred embodiments, there are a plurality of either or both the water-absorbent material impregnated with cleansing agent and the water-absorbent material free of that cleansing agent, may be present as a plurality thereof, as sets thereof.

For any such set, the material may be in the form of a plurality of separate sheets as one preferred embodiment, or as a plurality of strips as another preferred embodiment.

The above-noted sheets and strips are preferably of paper, or at least the make-up thereof being of a major proportion of paper, being thereby more readily disposable and light in weight, and inexpensive to produce and sell.

The invention may be better understood by making reference to the following Figures.

THE FIGURES

FIG. 1 in exploded view illustrates a preferred combination of the invention in side perspective view of a floor mop with its handle and clamping device mounted thereon.

FIG. 2 in an in-part view taken in side perspective illustrates an alternate embodiment showing a different mop in the mounted state, the mechanism for mounting by the clamping device onto its handle being the same as that illustrated for the FIG. 1 embodiment.

DETAILED DESCRIPTION OF THE INVENTION

Figure 1:
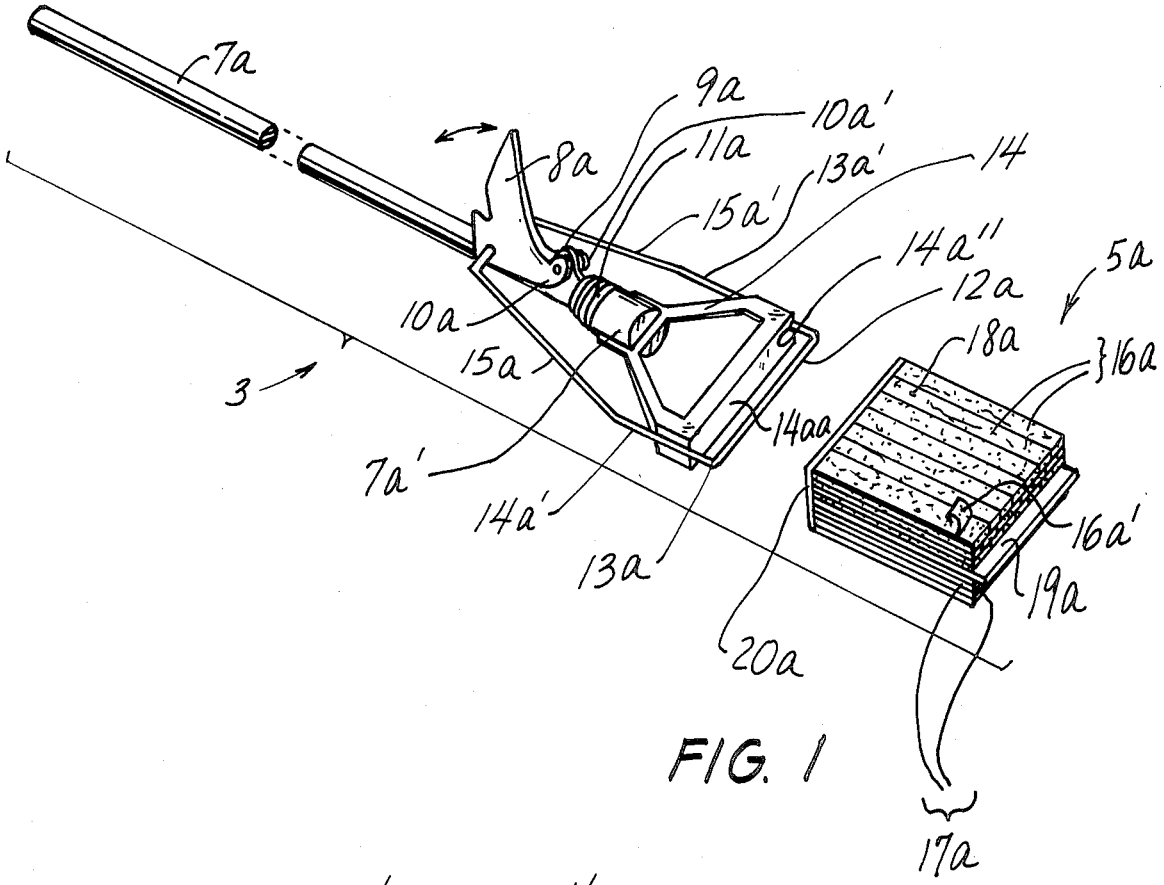
Figure 2:
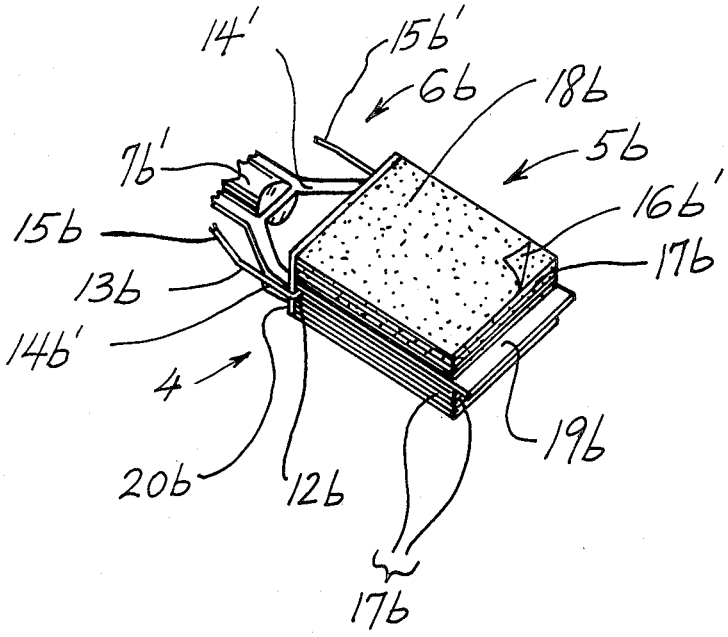

Except for the differences in the mops of FIGS. 1 and 2 as shall be pointed out below, the embodiments of FIGS. 1 and 2 are otherwise identical, and accordingly identical indicia are used in both Figures such as items 5*a* illustrating the mop of FIG. 1 and 5*b* illustrating the mop of FIG. 2, for example. Accordingly, when an element is described for one Figure or embodiment, the description is not repeated for the other embodiment of Figure, except to the extent of usefulness in further description or discussion.

Thus, in FIG. 1 there is shown the mop 5*a* which together with the handle 7*a* and clamping device 6*a* make up the total mop combination 3.

The mop 5*a* includes a first set of strips of paper broadly designated as 16*a*, such as strip 16*a'* impregnated with a soap illustrated as particles 18*a*. Strips 16*a* are free of any attachment at one end of their elongated structures that are normally thin but with sufficient thickness as to not readily disintegrate when moistened or wet, but are attached at the other end by water-resistant adhesive, or by any other conventional mechanism as sewing as the like, such as with tablets, attached to the binding header 20*a*. The mop 5*a* also includes a second set of strips of paper broadly designated as 17*a* substantially identical to strips 16*a*, except that strips 17*a* are free of any soap impregnation or of any other sudsing coating or impregnation or cleansing agent. Strips 17*a* are likewise free at one end of their elongated structures and are attached at an opposite end thereof to the binding header 20*a* by the same mechanism as the strips 16*a* are attached. Finally, the mop 5*a* also includes the water-impervious plastic sheet 19*a* positioned between strips 16*a* and 17*a*, preferably slightly longer than the strips 16*a* and 17*a* to facilitate complete separation of the non-impregnated strips 17*a* from impregnated strips 16*a* during moping of a floor with set strips 16*a* which would be then releasing the impregnated soap or detergent during scrubbing of a floor therewith. The plastic sheet 19*a* is likewise free at one end and attached or anchored otherwise at its opposite elongated structure to the binding header 20*a*.

The clamping device 6*a* includes a conventional type combination of structures such as binding element 11*a* attaching the structure 14 to the handle 7*a*, and the protruding element 9*a* protruding upwardly from structure 14 and having an aperture therethrough through which a pin 10*a*'' mounts clamping handle 8*a* by spaced-apart apertured members 10*a* and 10*a*', noting that the pivot point of the pin 10'' is elevated above the level of clamping-stress through elements 12*a*, 13*a*, 15*a* that are pivoted on and by attachment of the element 15*a* to a lower portion of clamping handle 8*a* above-noted. The portion or element 12*a* becomes clamped close to the flat surface 14*aa* when clamping handle 8*a* is pressed downwardly in a clamping state and position, such that when the set of strips 16*a* are threaded through the loop space between element 12*a* and surface 14*aa*. Preferably there is a groove or slot 14*a*'' on one edge of structure 14 and groove or slot 14*a*' on an opposite edge thereof into which the elements 13*a* and 13*a*' fit and slide axially when the clamping handle 8*a* is raised or lowered, noting that the material therefore of the elements 15*a* and 15*a*' is flexible such as flexible metal or plastic. Thus, FIG. 1 illustrates the clamping device 6 mounted on the distal end 7*a*' of the elongated handle 7*a* with the clamping handle 8*a* in the clamping position. The directions of movement of the handle 8*a* is illustrated by an adjacent associated arced arrow, and likewise the alternate directions of movement of the element 12*a* is illustrated by the adjacent associated line having oppositely-directed arrows. It is noted that the mop 6*a* set of strips 16*a* have preferably a plurality of consecutive layers of the strips as well as preferably a plurality of side-by-side strips. However, the strips may be grouped in any other desired or conventional fashion, provided they remain segregated or separated from the strips 17*a*. Likewise, the strips 17*a* preferably have consecutive layers one on top of the other, and also preferably a plurality of side-by-side strips, as illustrated, but may be some other arrangement.

The FIG. 2 basically differs in its illustrated embodiment of the mop 5*b* sheets 16*b* and sheets 17*b* are in fact sheet-like rather than the strips of 16*a* and 17*a*. Otherwise there are no differences in the embodiments of mops 5*a* and 5*b*. Accordingly, the sheets 16*b* are impregnated with soap or detergent graphically illustrated as particles 18*b*, as shown for example on single sheet 16*b*'. The sets of sheets 16*b* and 17*b* are segregated or separated by the plastic or rubber or other water-impervious sheet as previously noted in the above and also in the broad description. The only other significant difference in the illustrations of FIGS. 1 and 2, is that in FIG. 2 the illustration is not exploded view, but is shown in the mop-mounted state, with the element 12*b* being positioned between the sheets 16*b* and the sheet 19*b*, clamped against an inside-surface of the binding header 20*b*.

It is within the contemplation of the invention to utilize for the strips 16*a* and 17*a* and/or the sheets 16*b* and 17*b*, or any one or more sets thereof, material that is other than paper, and/or partially some other material such as spong-combination and/or cloth and/or paper-combination, or one or more thereof, and possibly in combination with backing material of some sort, such as plastic or rubber backing or support strips or the like.

Likewise, the invention may utilize any desired cleansing agent that may or may not be a soap or detergent, and combinations of one or more thereof.

In like manner, while a preferred embodiment of the clamping device 6*a* is illustrated, any suitable or desired and/or conventional commercially-available clamping device may be substituted within the broader scope of the invention as illustrated and described and claimed in the appended claims.

It is within the scope of the invention to make variations and modifications within ordinary skill of the art, including substitution of equivalents.

As noted above, the combination or mop alone, may be with or without the cleansing agent, i.e. the mop strips 16*a* and mop sheets 16*b* may be used in association with such cleansing agent at the time of use, such as at the time of use merely using those strips or sheets in a moistened state or wet, to scrub a floor having cleansing agent such as typically soap or detergent spread thereon or at the time of use spread onto the strips 16*a* or sheets 16*b*. Thus, broadly the invention is to the specific mop structure alone, devoid of any cleansing agent applied thereto, for use in such manner.

There is no relevant prior art. The sole patent at all relating even distantly are as follows. U.S. Pat. No. 2,233,289 dated Feb. 25, 1941 to Hatzenbuehler discloses a mop having packets of paper strips bound by a felt strip onto a metal wire support. None of the packets are separated from other bundles thereof. The U.S. Pat. No. 3,230,565 dated Jan. 25, 1966 to Koch discloses other non-separated (not segregated from one-another) paper strips, and No. 3,827,099 dated Aug. 6, 1974 to Aliaire disclosing mop paper strips also not segregated from one-another. Patents disclosing paper sheets not segregated from one-another include U.S. Pat. No. 2,733,468 dated Feb. 7, 1956 to Haber, and U.S. Pat. No. 2,743,471 dated May 1, 1956 to Forrester. None of these patents have suggested nor contemplated the present invention's structure, combination or mechanism of use in combination with a cleansing agent such as soap or detergent.

I claim:

1. A floor wetable-type mop device of disposable nature, consisting essentially of, in combination: at least two flexible first and second water-absorbent materials separated by a flexible third water-impervious material, one of said first and second water-absorbent materials including thereon a water-miscible cleansing agent, and the remaining one of the first and second water-absorbent materials being free of any water-miscible cleansing agent, said first and second water absorbent materials and said third water-impervious material being adapted for mounting on a mop handle to dangle therefrom such that optionally alternate ones of said first and second water-absorbent materials may be utilized in mopping for alternately applying and removing cleaning agent from a floor surface to be mopped.

2. A floor wetable-type mop device of claim 1, in which said cleansing agent is miscible with water to produce a cleansing mixture when water is applied to the water-absorbent material having the cleansing agent thereon.

3. A floor wetable-type mop device of claim 2, in which said cleansing agent is soap.

4. A floor wetable-type mop device of claim 3, including means for anchoring together a common end of each of the two water-absorbent materials and the water-impervious material, leaving an opposite end of each in an unanchored state and condition.

5. A floor wetable-type mop device of claim 4, including an elongated handle mounted on said means for anchoring.

6. A floor wetable-type mop device of claim 5, in which at-least one of said two water-absorbent materials comprises a plurality of separate sheets.

7. A floor wetable-type mop device of claim 5, in which at-least one of said two water-absorbent materials comprises a plurality of strips.

8. A floor wetable-type mop device of claim 1, in which at least one of said two water-absorbent materials includes a major proportion of paper.

9. A floor wetable-type mop device of claim 8, in which both of said two water-absorbent materials comprise a plurality of strips.

10. A floor wetable-type mop device of claim 9, including anchoring means for anchoring together a common end of each of the two water-absorbent materials and the water-impervious material, and including an elongated handle mounted on said anchoring means.

* * * * *